US007140802B2

(12) United States Patent
Lamore

(10) Patent No.: US 7,140,802 B2
(45) Date of Patent: Nov. 28, 2006

(54) RETRACTABLE WIDE-SPAN VEHICLE BARRIER SYSTEM

(76) Inventor: Michael J. Lamore, 818 Northern Shores Point, Greensboro, NC (US) 27455

( * ) Notice: Subject to any disclaimer, the term of this patent is extended or adjusted under 35 U.S.C. 154(b) by 0 days.

(21) Appl. No.: 11/263,703

(22) Filed: Nov. 1, 2005

(65) Prior Publication Data

US 2006/0140718 A1 Jun. 29, 2006

Related U.S. Application Data

(63) Continuation-in-part of application No. 11/065,494, filed on Feb. 24, 2005, now Pat. No. 7,083,357.

(60) Provisional application No. 60/639,935, filed on Dec. 29, 2004.

(51) Int. Cl.
*E01F 13/00* (2006.01)

(52) U.S. Cl. ..... 404/6

(58) Field of Classification Search ..... 404/6, 404/10; 256/1, 13.1; 49/49
See application file for complete search history.

(56) References Cited

U.S. PATENT DOCUMENTS

| | | | |
|---|---|---|---|
| 3,013,750 | A | 12/1961 | Fondén et al. |
| 3,307,833 | A | 3/1967 | Müller et al. |
| 3,367,608 | A | 2/1968 | Charno et al. |
| 3,484,061 | A | 12/1969 | Niemkiewicz |
| 3,622,107 | A | 11/1971 | Bernard |
| 3,738,599 | A | 6/1973 | Borehag |
| 3,827,660 | A | 8/1974 | Doolittle |
| 3,876,170 | A | 4/1975 | Whittingham |
| 3,938,763 | A | 2/1976 | DiGiovanniantonio |
| 4,056,247 | A | 11/1977 | Bernard et al. |
| 4,147,317 | A | 4/1979 | Mayhew et al. |
| 4,630,395 | A | 12/1986 | Nasatka |
| 4,824,282 | A | 4/1989 | Waldecker |
| 4,979,701 | A | 12/1990 | Colarik et al. |
| 5,592,149 | A | 1/1997 | Alizi |
| 5,624,203 | A | 4/1997 | Jackson et al. |
| 5,762,443 | A | 6/1998 | Gelfand et al. |
| 5,823,705 | A | 10/1998 | Jackson et al. |
| 5,829,912 | A | 11/1998 | Marcotullio et al. |
| 5,961,099 | A | 10/1999 | Thommen, Jr. |
| 5,993,104 | A | 11/1999 | Marcotullio et al. |
| 6,186,274 | B1 | 2/2001 | Reynolds et al. |

(Continued)

FOREIGN PATENT DOCUMENTS

WO WO-92/02688 9/1992

OTHER PUBLICATIONS

Universal Safety Response, Inc.; GRAB (Ground Retractable Automobile Barrier): The New Standard in Barrier Systems; http://www.usrgrab.com; Feb. 23, 2005.

(Continued)

*Primary Examiner*—Gary S. Hartmann

(57) ABSTRACT

There is provided a barrier system for stopping land-based and water-based vehicles from entering predetermined areas. The barrier system, which may protect relatively wide spans, is capable of stopping relatively high mass vehicles traveling at relatively high speeds. The barrier system comprises an anchoring system, vertical supports, an energy absorption unit, a gliding bar, and a net system. The gliding bar is selectively moveable relative to the energy absorption unit and may selectively define an unfixed mode wherein the gliding bar is moveable relative to the energy absorption unit and a fixed mode wherein the gliding bar is fixed relative to the energy absorption unit. The net system is connected to the gliding bar such that converting the gliding bar from the unfixed mode to the fixed mode raises the net system to prevent passage of vehicles.

20 Claims, 15 Drawing Sheets

U.S. PATENT DOCUMENTS 6,312,188 B1 11/2001 Ousterhout et al.
6,322,285 B1 11/2001 Ben
6,327,818 B1 * 12/2001 Pease ..... 49/49
6,349,503 B1 * 2/2002 Gompertz et al. ..... 49/34
6,409,420 B1 6/2002 Horton et al.
6,485,225 B1 11/2002 Baker
6,581,875 B1 6/2003 Colarik
6,843,613 B1 1/2005 Gelfand et al.
6,845,589 B1 * 1/2005 Thompson et al. ..... 49/49

OTHER PUBLICATIONS

Miscellaneous Information on GRAB-sp Barrier System (5 pgs.).
Israel building underwater wall, World Tribune.com, Feb. 3, 2006, 1 pg.
Gnessin, Alex, Israel to Build Undersea Barrier to Ward Off Attacks, The Epoch Times, Jun. 21, 2005, 1 pg.

* cited by examiner

RETRACTABLE WIDE-SPAN VEHICLE BARRIER SYSTEM

CROSS REFERENCE TO RELATED APPLICATION

This application is a continuation-in-part of U.S. patent application Ser. No. 11/065,494, filed on Feb. 24, 2005 now U.S. Pat. No. 7,083,357, which claims priority of U.S. Provisional Application Ser. No. 60/639,935, filed Dec. 29, 2004, all of which is hereby incorporated herein in its entirety by reference.

BACKGROUND OF THE INVENTION

1. Field of the Invention

The present invention is related to vehicle barrier systems, and more particularly, to a barrier system that is selectively retractable.

2. Description of Related Art

Originally, net-based barrier systems with energy absorption devices at end supports were associated with aircraft arresting devices. These systems are designed so that the aircraft arresting net system is let out more than 100 feet upon impact and the aircraft slowly decelerates to a stop over a long distance, to minimize damage to the aircraft. Such systems are not directly applicable to vehicle barrier systems because the net system, energy absorption units, and end supports of vehicle barrier systems are designed to completely stop vehicle over a short distance regardless of the amount of damage caused to the vehicle.

Vehicle barrier systems rated to stop a 15,000 pound vehicle at impact speed of fifty miles per hour of the prior art include large sliding steel gates, steel bollards filled with concrete and anchored into footings, interlocking concrete surface barriers, horizontal steel bars with end supports, pop up steel plates, steel cable systems at short spans with fixed end supports, and other related barrier systems of the prior art. These barrier systems are limited by the length of area that can be secured without adding fixed supports that penetrate the subsurface, and this limitation is typically fifteen to sixty feet. In addition, these barrier systems require an electrical power supply, require backup power systems, and use hydraulics or pistons, resulting in maintenance, repairs, and downtime of the barrier. Many of these systems are not an "all weather" use. These barrier systems are either semi-fixed in-place and are not easily removed, or permanently fixed in-place and, therefore, permanently block off vehicle access to the secured area. Onsite installation of prior art systems can take several weeks. System components are neither modular nor disconnected easily. Barriers made of steel and concrete create additional projectiles upon an impact event, and require significant repair work in the aftermath to restore a barrier to operational status.

BRIEF SUMMARY OF THE INVENTION

The invention addresses the above needs and achieves other advantages, such as stopping either land-based or water-based vehicles, by providing a barrier system that may be selectively raised and lowered using at least one gliding bar. The gliding bar, which in some embodiments of the present invention glides in a generally horizontal direction, is selectively convertible between an unfixed mode in which the gliding bar is moveable relative to an energy absorption unit and a fixed mode in which the gliding bar is fixed relative to the energy absorption unit. A gliding bar retainer is provided to selectively fix the gliding bar relative to the energy absorption unit. The net system is attached to a net end of the gliding bar such that converting the gliding bar from the unfixed mode to the fixed mode raises the net system and vice versa.

A barrier system of one embodiment comprises an anchoring system, at least one end support including a vertical support attached to the anchoring system, and an energy absorption unit supported by the vertical support. The energy absorption unit of some embodiments of the present invention comprises a compression spring. The barrier system further comprises a gliding bar that selectively defines an unfixed mode wherein the gliding bar is moveable relative to the energy absorption unit and defines a fixed mode wherein the gliding bar is fixed relative to the energy absorption unit. The gliding bar of some embodiments of the present invention is moveable relative to the energy absorption unit in a generally horizontal direction. The gliding bar is selectively convertible between the unfixed mode and the fixed mode and in some embodiments defines an axial length that is selectively adjustable, such as by axially sliding a sleeve and core of the gliding bar relative to one another, to describe one non-limiting example. The barrier system further comprises a net system connected to a net end of the gliding bar. The barrier system also comprises at least one gliding bar retainer for selectively fixing the gliding bar relative to the energy absorption unit when the gliding bar defines the fixed mode.

Other aspects of the present invention also provide methods for raising a net system of a barrier system for stopping vehicles. The method of one embodiment includes providing a net system that is connected to a net end of at least one gliding bar, wherein the gliding bar is moveable relative to an energy absorption unit that is supported by a vertical support that is attached to an anchoring system. The gliding bar selectively defines an unfixed mode wherein the gliding bar is moveable relative to the energy absorption unit and defines a fixed mode wherein the gliding bar is fixed relative to the energy absorption unit. The method further comprises converting the at least one gliding bar from the unfixed mode to the fixed mode to raise the net system. Further methods of the present invention include actuating a gliding bar retainer to selectively engage a surface of the gliding bar. Still further methods of the present invention include remotely controlling a winch device to move the gliding bar relative to the energy absorption unit and remotely controlling the gliding bar retainer to selectively engage the surface of the gliding bar.

BRIEF DESCRIPTION OF THE SEVERAL VIEWS OF THE DRAWINGS

Figure 1:
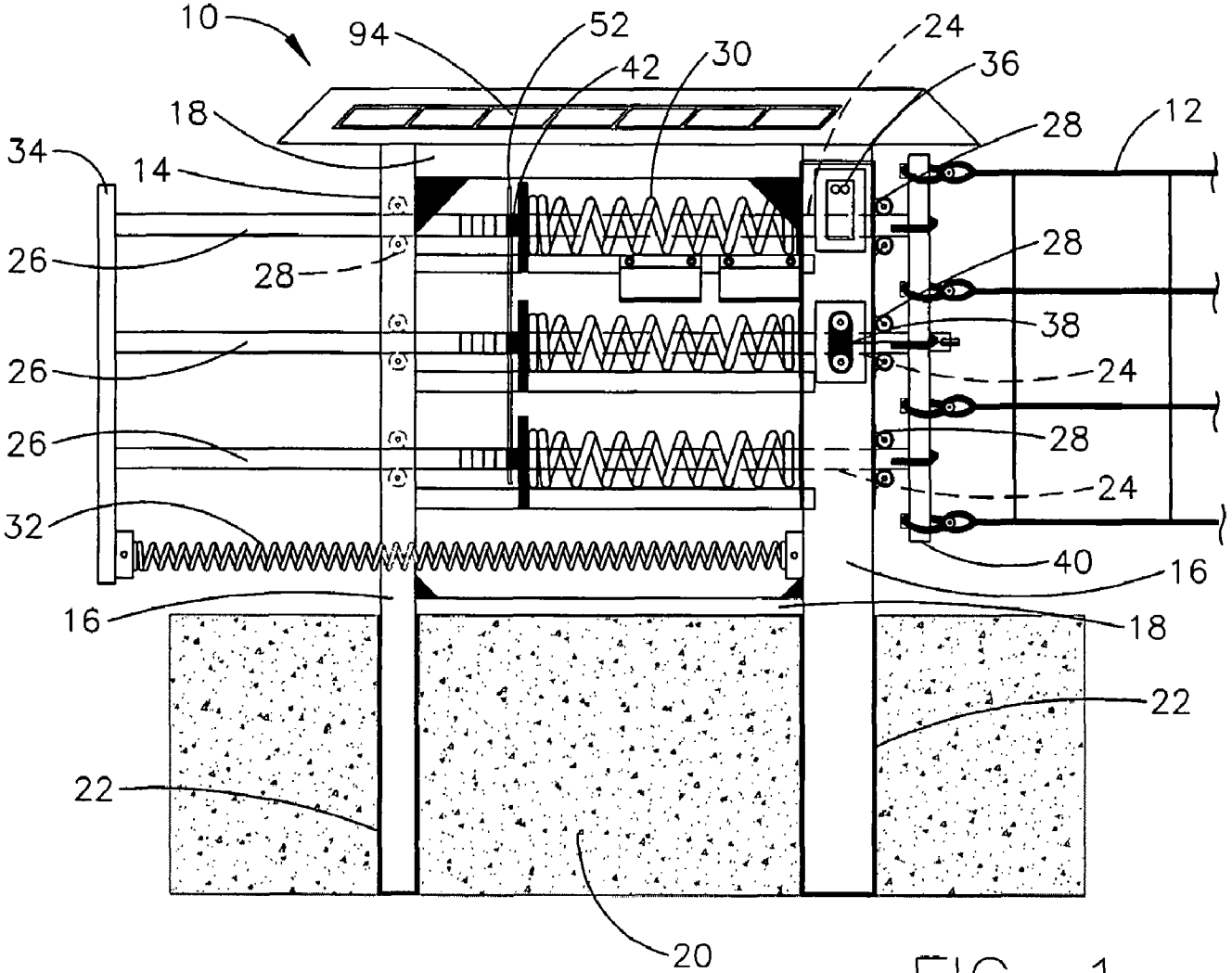
Figure 2:
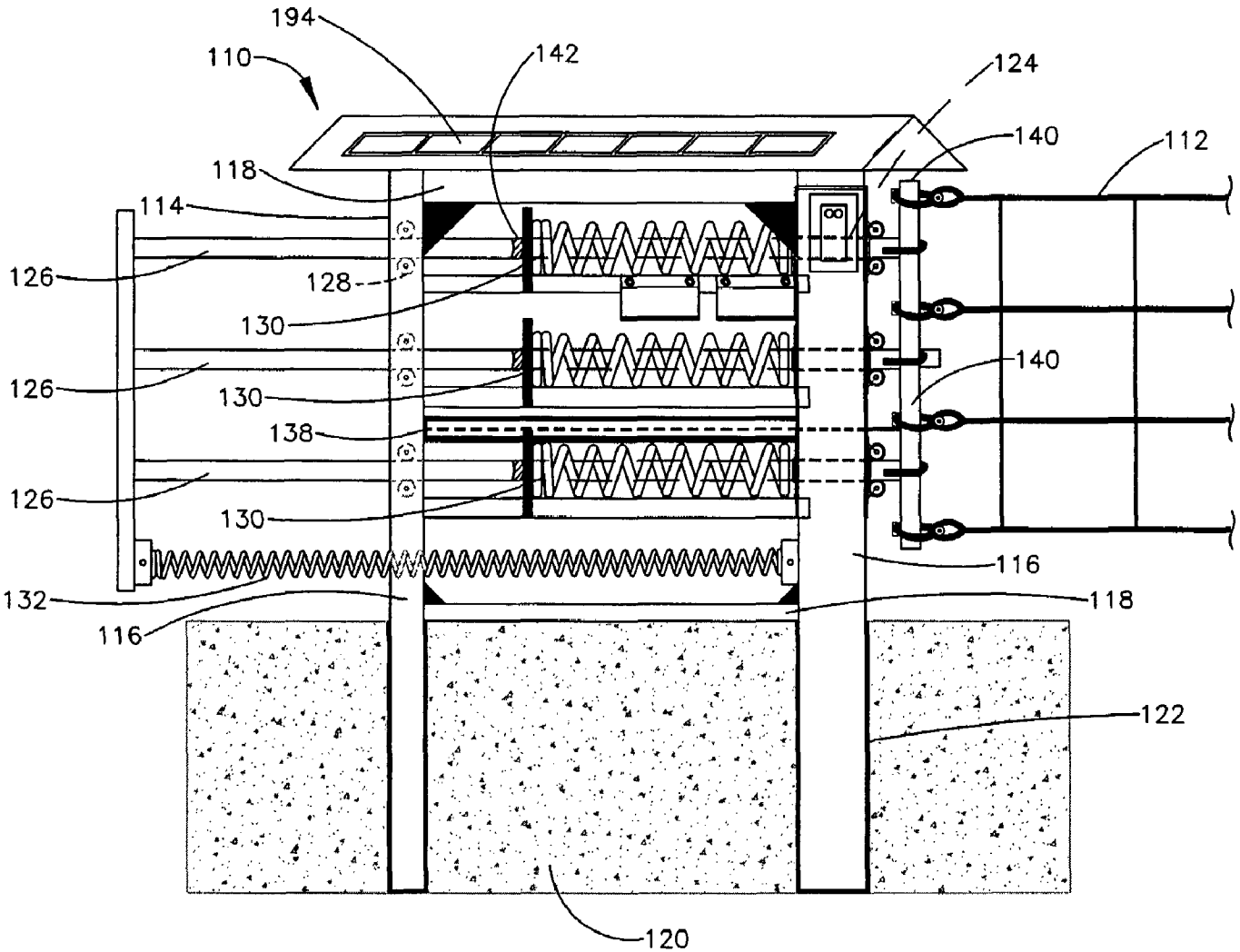
Figure 3:
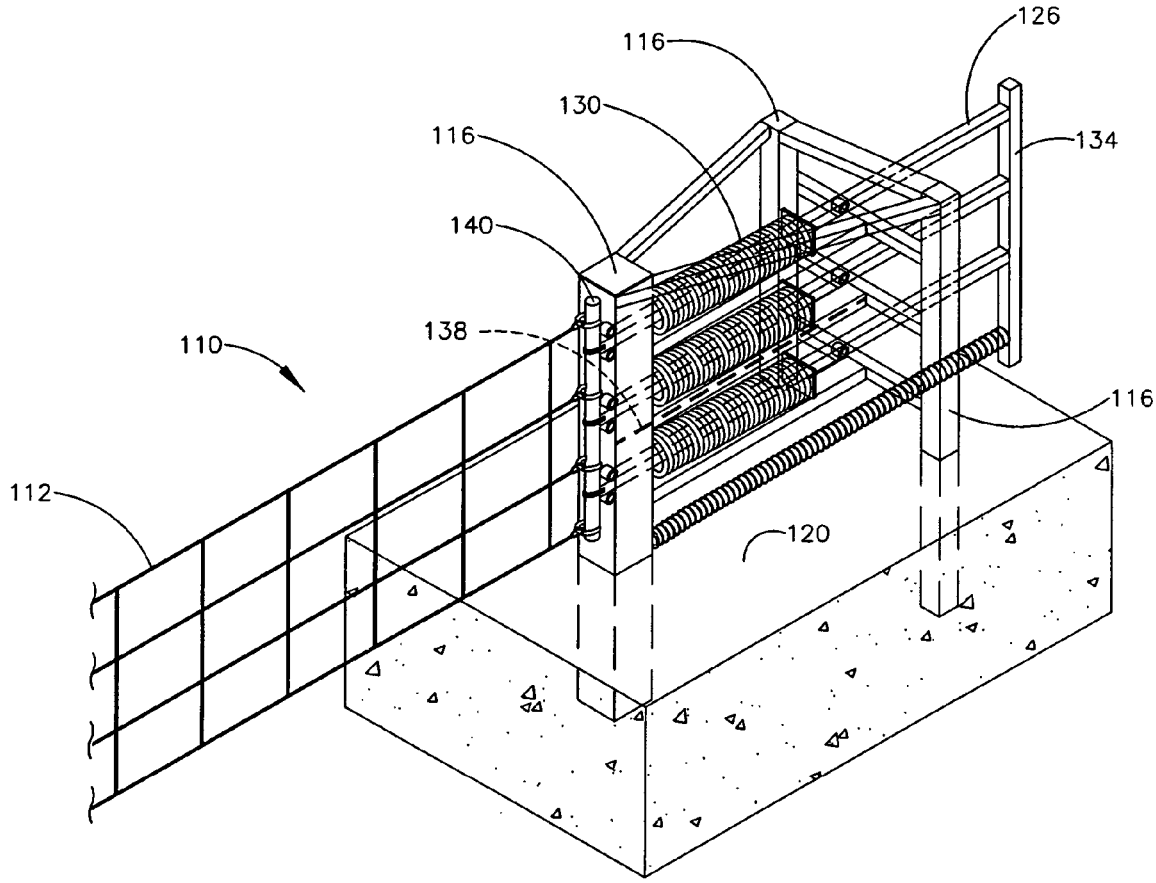
Figure 4:
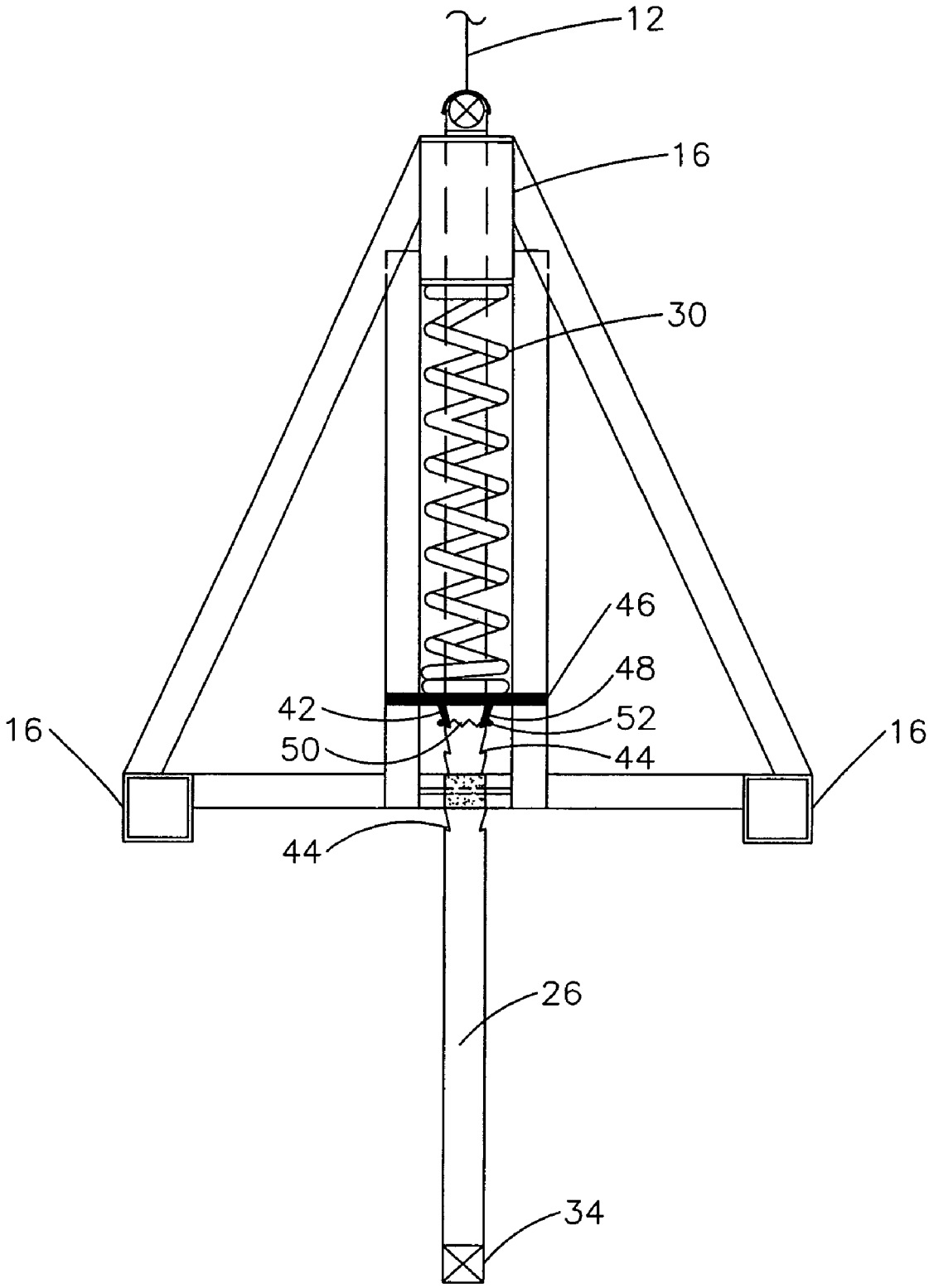
Figure 5:
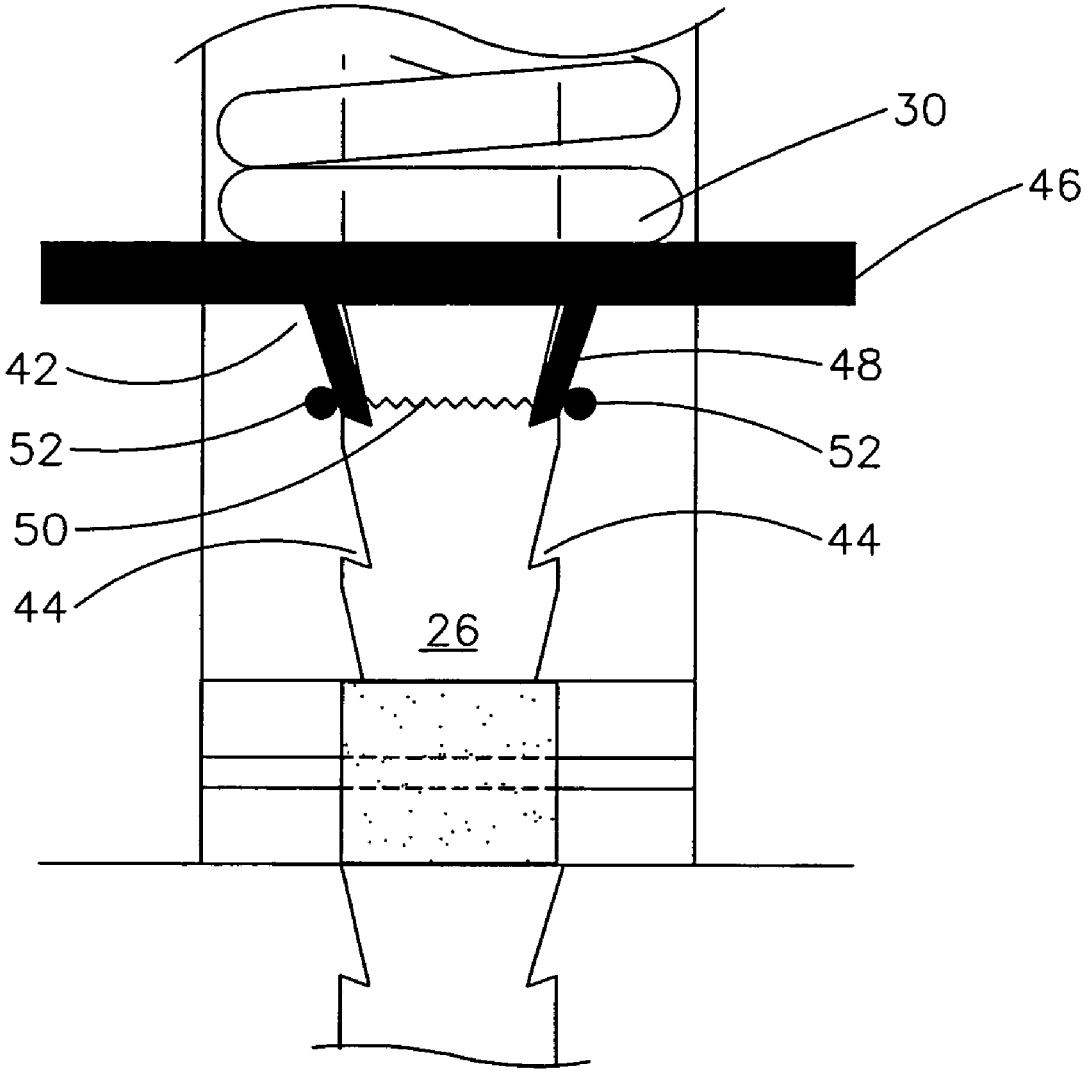
Figure 6:
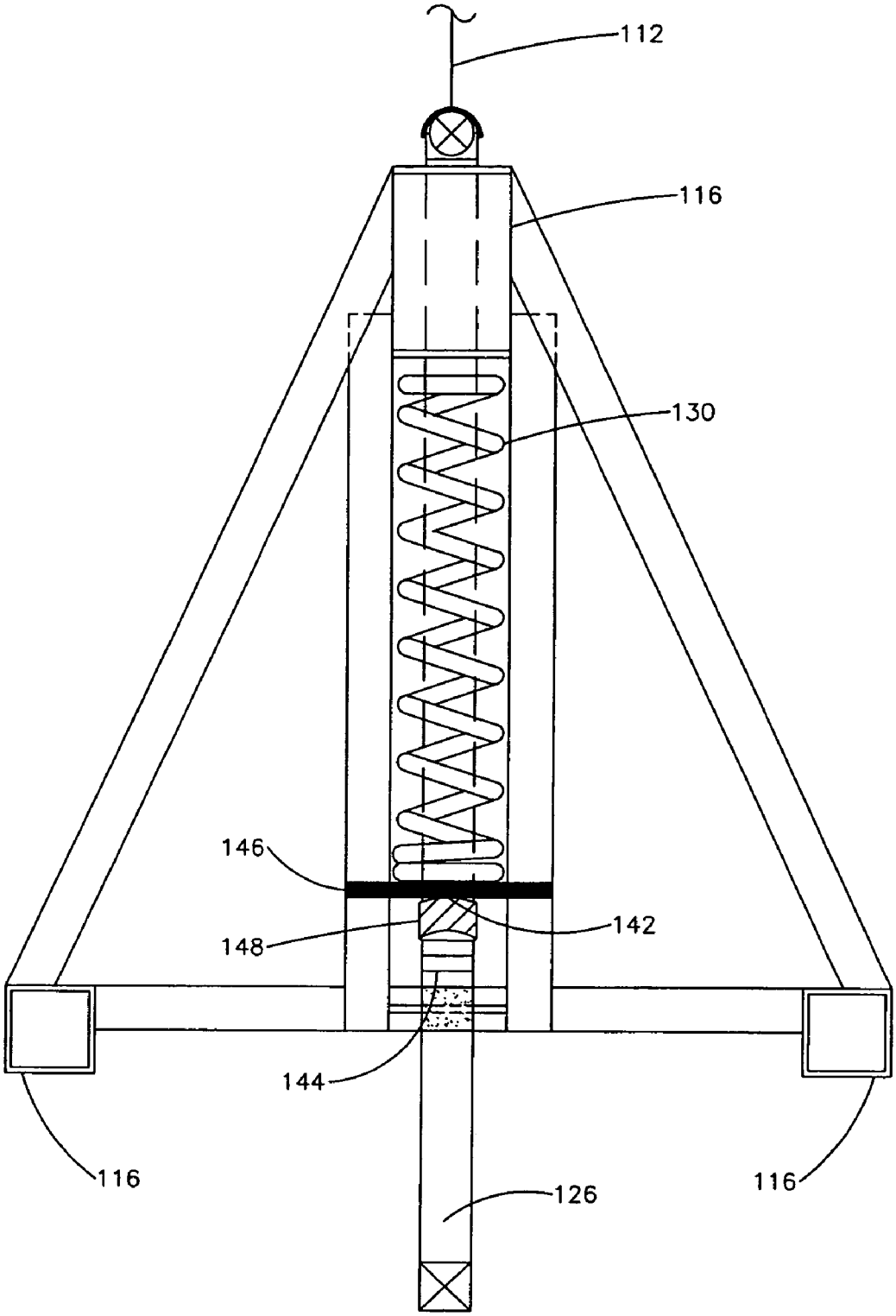
Figure 7:
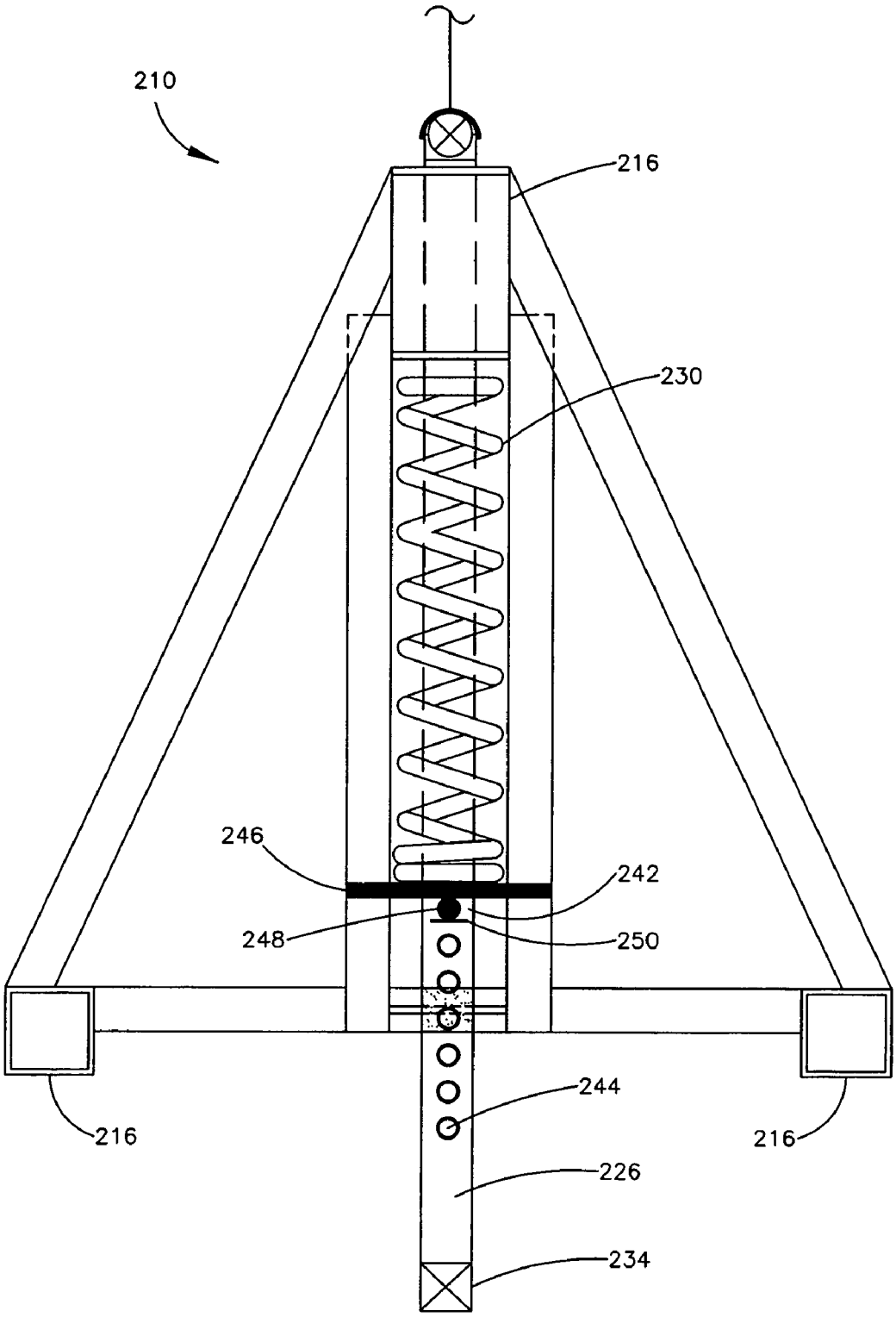
Figure 8:
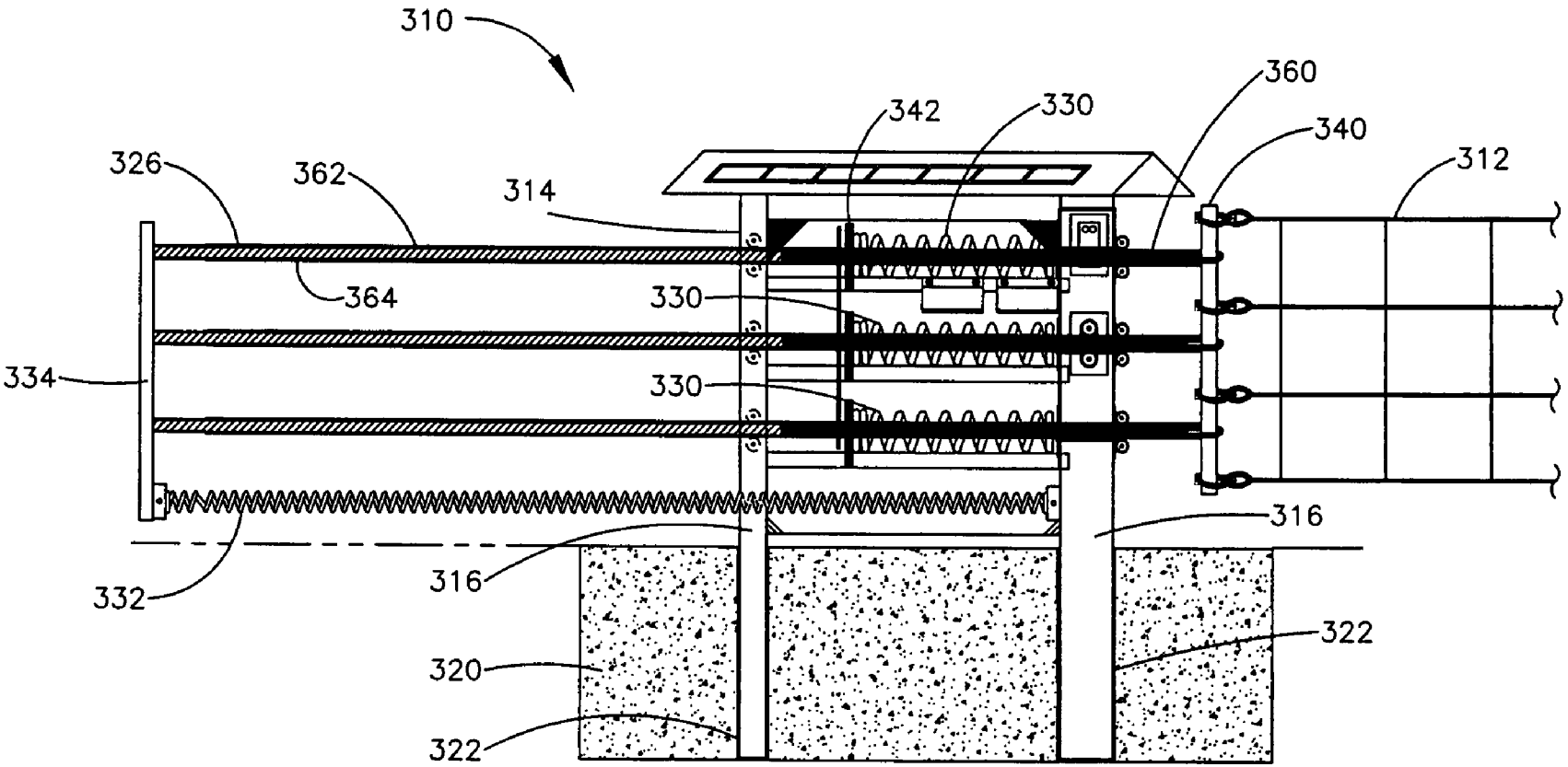
Figure 9:
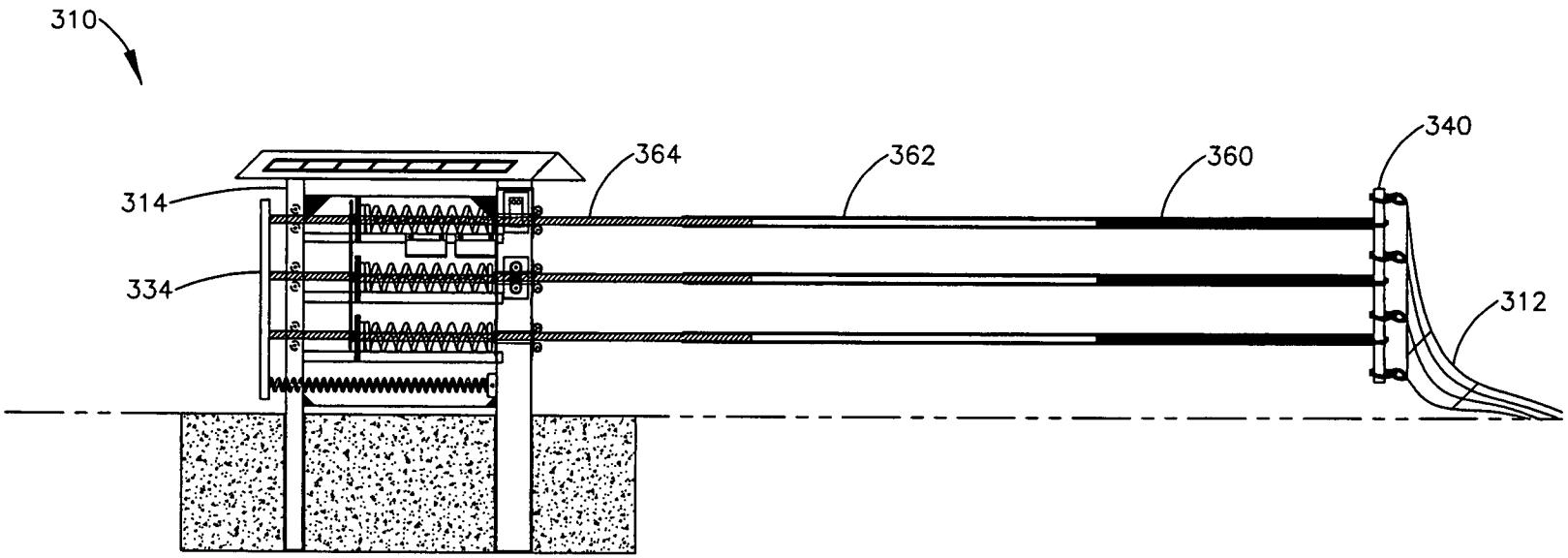
Figure 10:
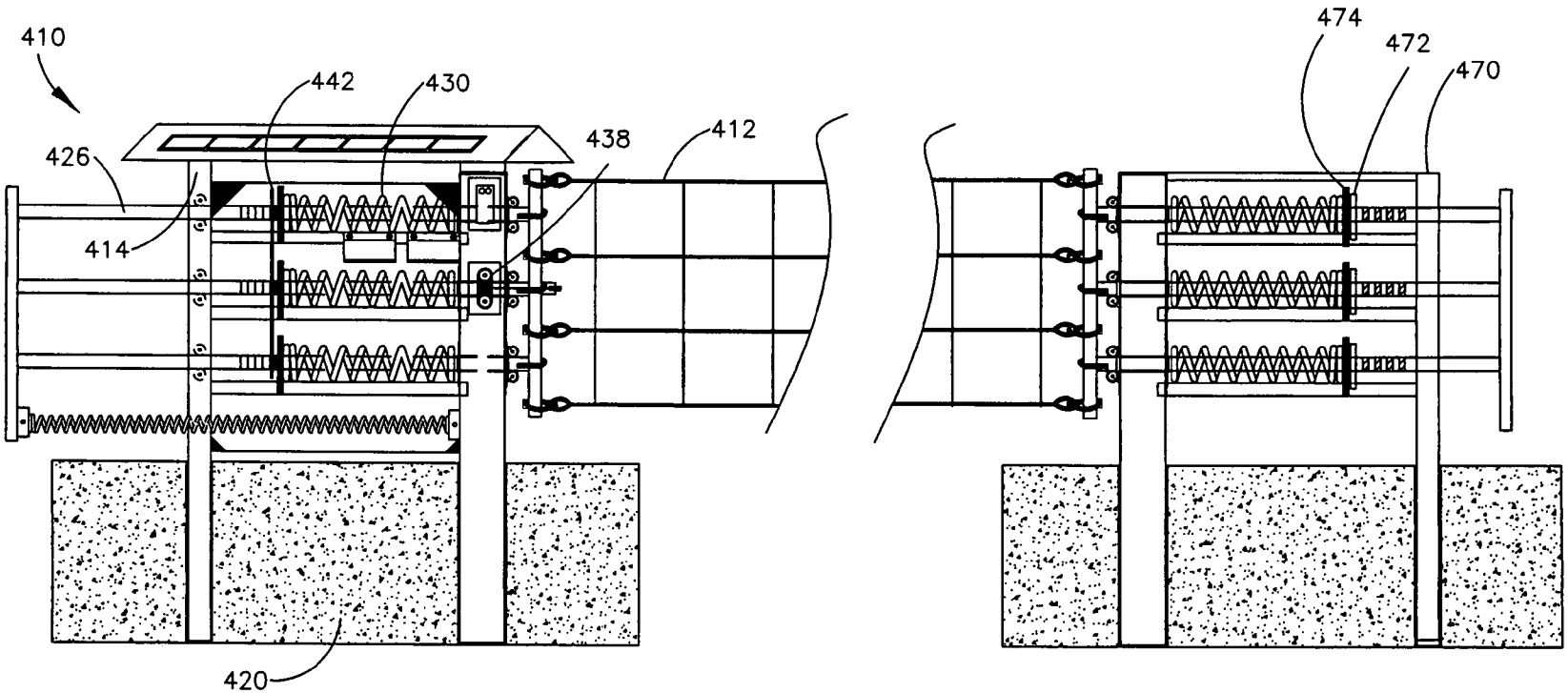
Figure 11:
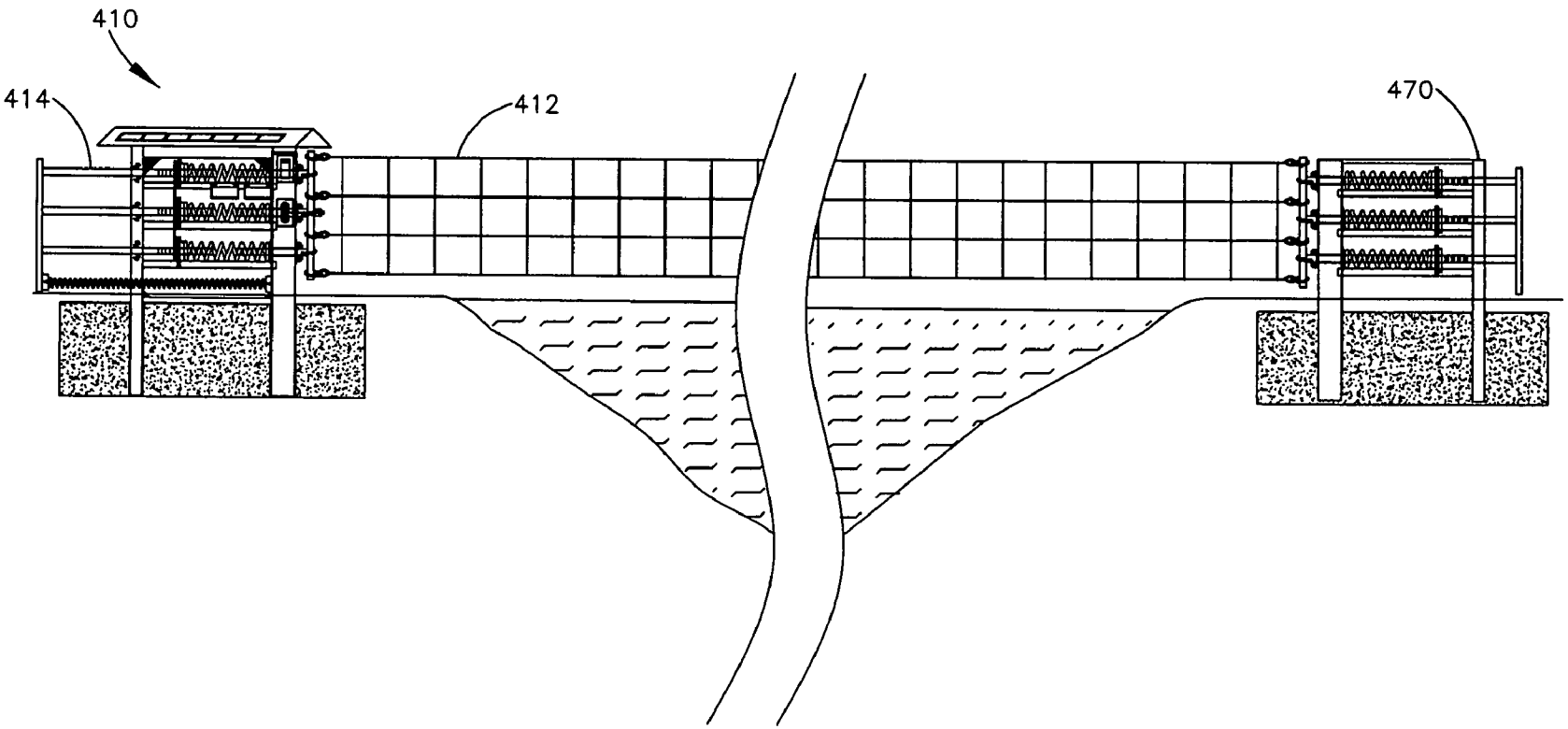
Figure 12:
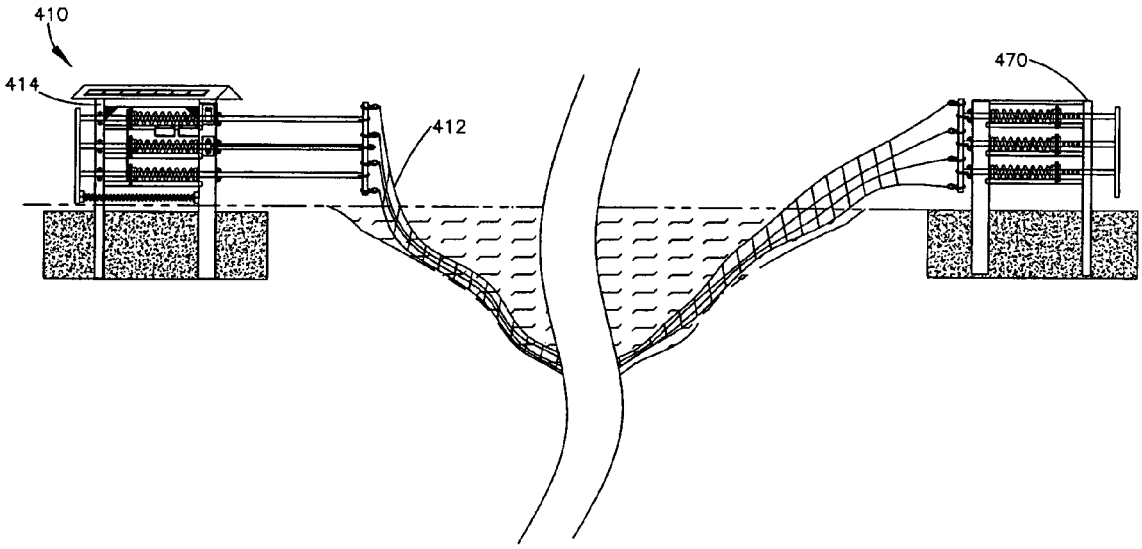
Figure 13:
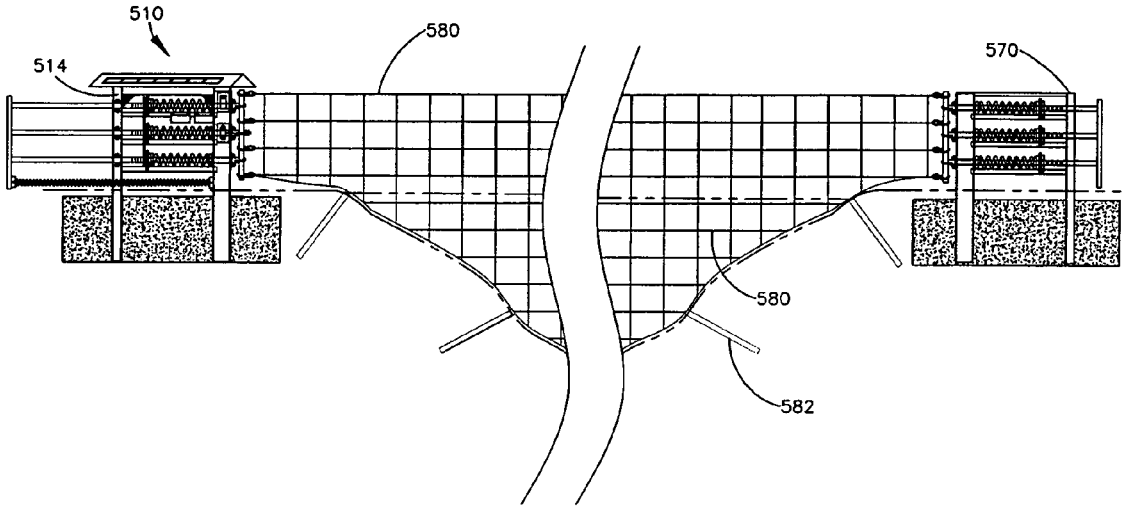
Figure 14:
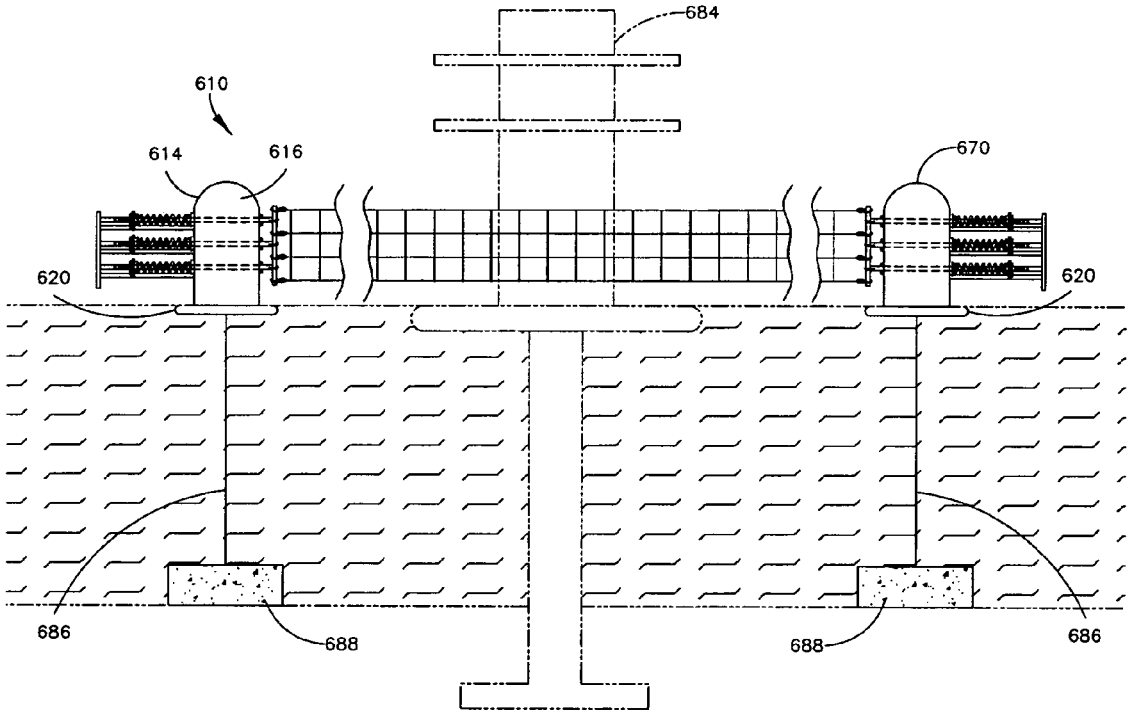
Figure 15:
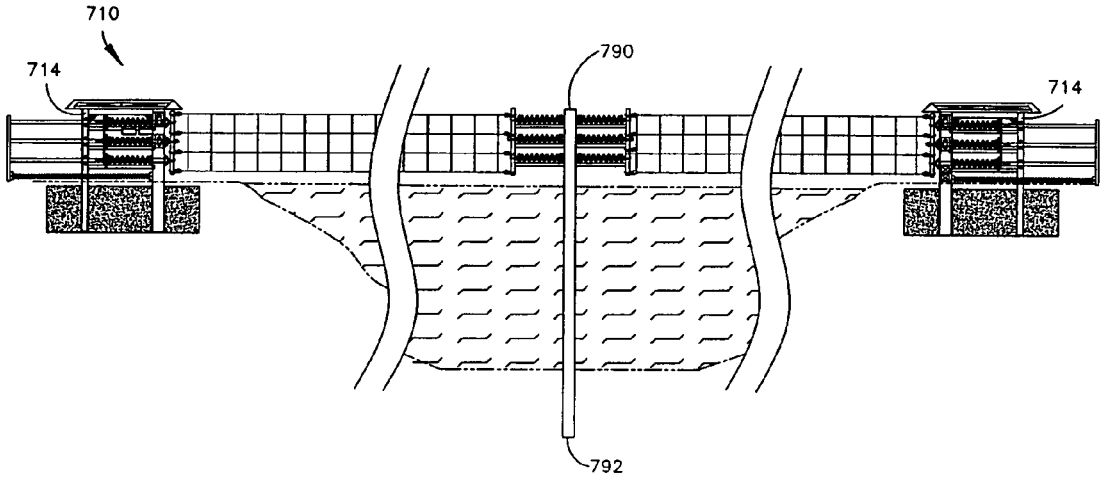

Having thus described the invention in general terms, reference will now be made to the accompanying drawings, which are not necessarily drawn to scale, and wherein:

FIG. 1 is a side elevational view of one embodiment of the barrier system, illustrating one end support with three energy absorption units, three gliding bars, a winch system, a force equalization bar, and a net system;

FIG. 2 is a side elevational view of a second embodiment of the barrier system, illustrating one end support with three energy absorption units, three gliding bars, a hydraulic system, a force equalization bar, and a net system;

FIG. 3 is a perspective view of the barrier system of FIG. 2, illustrating the barrier system without the roof assembly;

FIG. 4 is an enlarged top elevational view of the end support of FIG. 1, illustrating a gliding bar retainer comprising a flange device for selectively engaging at least one notch on an outer surface of the gliding bar;

FIG. 5 is a further enlarged top elevational view of the gliding bar of FIG. 1, illustrating a gliding bar retainer;

FIG. 6 is an enlarged top elevational view of the end support of FIG. 2, illustrating a gliding bar retainer comprising a collar device for selectively engaging an outer surface of the gliding bar;

FIG. 7 is an enlarged top elevational view of the end support of a third embodiment of the barrier system, illustrating a gliding bar retainer that comprises at least one removable pin connection;

FIG. 8 is a side elevational view of a fourth embodiment of the barrier system, illustrating a gliding bar that defines an axial length that is selectively adjustable, wherein the gliding bar defines a fixed mode;

FIG. 9 is a side elevational view of the barrier system of FIG. 8, illustrating a gliding bar that defines an axial length that is selectively adjustable, wherein the gliding bar defines an unfixed mode;

FIG. 10 is a side elevational view of a fifth embodiment of the barrier system, illustrating two end supports, wherein one support comprises solar panels and at least two rechargeable batteries for providing power to the winch system and gliding bar retainer;

FIG. 11 is a side elevational view of the barrier system of FIG. 10, illustrating the net system in an "up" position across a waterway to deny access to surface marine traffic;

FIG. 12 is a side elevational view of the barrier system of FIG. 10, illustrating the net system in a "down" position across a waterway to allow access to surface marine traffic;

FIG. 13 is a side elevational view of a sixth embodiment of the barrier system, illustrating two end supports and a net system that comprises a full depth net system, wherein the net system is illustrated in an "up" position with anchors into the channel bottom such that the net system denies access to both surface marine traffic and submarine vessels or divers;

FIG. 14 is a side elevational view of a seventh embodiment of the barrier system, illustrating two end supports attached to anchoring systems comprising buoy systems, wherein the barrier system provides a barrier to protect offshore oil and gas production facilities or other facilities; and FIG. 15 is a side elevational view of an eighth embodiment of the barrier system, illustrating two end supports and one intermediate support with the net system in an "up" position to deny access to surface marine traffic in a relatively wide waterway;

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements.

With reference to FIGS. 1–15, various embodiments of the barrier system of the present invention are illustrated. The barrier system is provided to prevent a vehicle from passing into a particular area. As used herein, the term vehicle comprises land-based vehicles, such as automobile, trucks, or the like to list non-limiting examples; water-based vehicles, such as boats, submarines, or the like to list non-limiting examples; or air-based vehicles, such as hover crafts, helicopters, airplanes, or the like to list non-limiting examples. The term vehicle also comprises any transportation device that may or may not include human occupants and also comprises systems that facilitate human transport, such as scuba systems, to mention one non-limiting example. The present invention is related to barrier systems that are capable of spanning relatively long distances, such as distances of eighty feet or more, to list one non-limiting example. In addition, the barrier systems include net systems that can be raised or lowered across a road to deny or allow, respectively, access by trucks or automobiles, or the like and/or across a waterway to deny or allow access by boats or submarines or the like to describe non-limiting examples of applications for the barrier system of the present invention.

The barrier system of some embodiments of the present invention is capable of stopping a 15,000 pound vehicle at an impact speed exceeding fifty miles per hour and can free span more than two hundred fifty feet across a roadway, pathway, waterway, or other potential entry point, with or without the need for an intermediate fixed support within the waterway. The net system of some embodiments of the barrier system can be raised or lowered in less than sixty seconds, to deny or allow vehicle access; although further embodiments of the present invention may raise or lower the net system in less or more time. The barrier systems of some embodiments of the present invention enable an operator to manually raise and lower the net system, further embodiments enable an operator to electronically control the raising and lowering of the net system, and still further embodiments of the present invention enable an operator to remotely control the raising and lowering of the net system. For the embodiments of the present invention configured for use with a waterway, the barrier system includes a net system that will not degrade over an extended period of time, such as five years to list one non-limiting example, in fresh water or saltwater, nor degrade due to ultraviolet rays while in the "up" position. Some embodiments of the present invention eliminate the requirement for an external electrical power or fuel source. Further embodiments include wireless controls, such as a radio frequency device or satellite phone or the like to list non-limiting examples, to raise or lower the net system from a remote location. Still further advantages may be achieved by the various embodiments of the barrier system of the present invention, as described more fully below.

Referring now to the barrier system 10 of FIG. 1, the barrier system includes a net system 12 that is supported on each of two ends by an end support 14; however, further embodiments of the present invention comprise only one end support. Each end support 14 of the barrier system 10 of FIG. 1 includes three vertical supports 16 arranged in a triangular pattern, such as with an eight inch by twelve inch steel tube in front and two smaller six inch by six inch steel tubes at the rear to describe one non-limiting arrangement of vertical supports of the end support. The vertical supports may define polygonal (such as square, rectangular, or the like), circular, elliptical, or other cross-section to describe non-limiting examples of the cross-sectional shape of the vertical supports. Referring again to the end support 14 of the barrier system 10 of FIG. 1, each of the three vertical supports 16 are connected together for structural support using horizontal members 18, such as a three inch by three inch horizontal steel member to list one non-limiting example, attached at both the top and bottom of each vertical support. The vertical supports 16 support the energy absorption units, as described more fully below. This triangular shaped pattern for vertical supports, combined with the horizontal members, provide the end support strength to prevent or withstand the pullout, moment, shear, twist, torque, and other forces created when a vehicle impacts the net system. Alternative embodiments of the barrier system of the present invention include one or more vertical supports, depending upon the specific application requirements. For the barrier system 10 of FIG. 1, the steel components may be painted or hot dip galvanized, to protect against corrosion. Further embodiments of the present invention may include any size, number, shape, material, or pattern of components to provide the necessary support strength.

The end support 14 of the barrier system 10 of FIG. 1 is attached to an anchoring system 20. One non-limiting example of an anchoring system is a concrete subsurface fifteen feet wide by nineteen feet long by four feet deep that is reinforced with multiple layers of rebar, and containing dead man. The anchoring system of some embodiments of the present invention provides the necessary strength, weight, and surface area to prevent overturning, sliding, soil bearing failure, pullout and other failure events that might otherwise occur during a major impact event.

During installation of the anchoring system 20, a sleeve 22, such as a four foot long vertical steel sleeve to describe one non-limiting example, is installed in the anchoring system to provide for selective installation and/or removal of the vertical supports 16 of the barrier system 10. Further embodiments may construct the anchoring system around the vertical supports and/or horizontal members to provide a permanently anchored barrier system. The anchoring systems of the present invention may also utilize helical piers or earthen foundation anchoring systems to minimize the concrete foundation size and/or to overcome undesirable subsurface soil conditions. For the barrier system 10 of FIG. 1, the vertical supports 16 may be slid into the embedded steel sleeve 22, and pinned together in-place. The top of the anchoring system 20 may be poured twelve inches below grade, so that when the vertical supports 16 are subsequently removed, the anchoring system can be covered without noticeable signs of a previous barrier end support.

Further embodiments of the barrier system include an anchoring system that attaches the vertical supports to a four foot long by four foot wide steel framed pedestal, which is placed directly on the ground surface. Earthen anchors approximately one inch in diameter are driven through the steel framed pedestal and into the ground. A "cap" is installed at the top of the anchor to secure the bottom steel pedestal against the ground, without using concrete. The end supports are easily removed by cutting off the earthen anchors, and lifting the end support unit onto a truck for transport and subsequent use. Therefore, a barrier system that can be more conveniently installed and removed, and in a relatively shorter time period, such as four hours for some embodiments, are provided by further embodiments of the present invention. Such barrier systems are well-suited to provide protection from falling rocks or other situations that require timely installation. Still further barrier systems incorporate a hinge system to allow the vertical supports to be tilted over after removing the pins. Alternative devices for mounting the vertical supports to the anchoring system and/or for concealing the anchoring system are provided by the present invention.

Referring again to the barrier system 10 of FIG. 1, the vertical support 16 proximate the net system 12 includes gliding bar openings 24 through which a gliding bar 26 may slide horizontally. The gliding bar openings 24 may comprise three four inch by four inch openings through which gliding bars of three and a half inches by three and a half inches by approximately fifteen feet long slide, to list non-limiting examples of opening size and bar size. Each of the openings in the vertical support may contain a sleeve and outside plate to reinforce the openings, such as with a quarter inch steel sleeve and half inch thick steel outside plate to list non-limiting examples of sleeve and plate sizes. The gliding bars 26 of FIG. 1 generally slide in unison left and right in a generally horizontal direction to raise and lower the net system 12. Two sets of high strength wheels 28 are mounted to the vertical support 16 proximate the openings 24 above and below each gliding bar 26 to facilitate horizontal sliding of the gliding bars; however, further embodiments of the invention may include wheels with grooved edges or other moving components at alternative locations.

Referring again to the barrier system 10 of FIG. 1, each gliding bar 26 is generally coaxial with an energy absorption unit 30, such that the gliding bar slides horizontally through the energy absorption unit when the gliding bar defines an unfixed mode, but the gliding bar is fixed relative to the energy absorption unit when the gliding bar defines a fixed mode. The energy absorption units 30 of FIG. 1 comprise compression springs that are supported by three inch by three inch steel members. The energy absorption units 30 are positioned between the vertical supports 16, as shown in FIGS. 1 and 4; however, further embodiments of the present invention position the energy absorption units at alternative locations relative to the vertical supports.

The barrier system 10 of FIG. 1 also includes a tension device 32 that is attached to at least one vertical support 16 and a gliding bar connector 34 to provide tension on the net so that the gliding bars, when in an unfixed mode, will lower the net system 12. The tension device 32 of FIG. 1 is beneath the gliding bars 26 and energy absorption units 30, such that the tension device is proximate the ground. The tension device 32 comprises a spring in tension; however, further embodiments of the barrier system comprise alternative tension devices in alternative positions or comprise no tension device such that the gliding bars lower the net system as a result of the weight of the net system. The tension device 32 of FIG. 1 is designed to be extended to the maximum pull back distance of the gliding bars 26 and then later provide the proper tension to pull the horizontal gliding bars inward and lower the net system 12. Conversely, as the net system 12 is pulled into the "up" position as described below, the tension device 32 is extended, and as the net system is lowered to the "down" position, the tension device provides tension to pull the gliding bars 26 to smoothly lower the net system. The tension device 32 of FIG. 1 requires substantially no maintenance or no electrical components and can be re-used.

The end support 14 of the barrier system 10 of FIG. 1 includes controls 36 to control the raising and lowering of the net system 12. A winch system 38 of FIG. 1 is the primary mechanism to pull back at least the center gliding bar 26 to raise the net system 12. The winch system 38 is attached to the vertical support 16 and includes a cable that is wound around a pulley or other snatch block assembly at the net end of the gliding bar 26. Therefore, the winching load capacity can be doubled and the winching speed reduced in half. A limit switch may be installed on the gliding bar 26 which activates automatic shut off of the winch motor of the winch system 38 once the bars are pulled back to a position that achieves the "up" position of the net system 12. This limit switch prevents the winch motor from continuing to operate and pulling back the winch cable too far.

FIG. 2 illustrates an alternative device for pulling back the net system 112 into the "up" position. The barrier system 110 of FIG. 2 includes a hydraulic system 138 that may or may not include pneumatic components, to quickly pull back the gliding bars 126 to raise the net system 112, such as in a period of five seconds or less to describe one non-limiting example of quickly raising the net system to an "up" position. The hydraulic system 138 of FIG. 2 includes a valve that may be opened once the system is activated to release an inert gas in a compressed state to push a piston that further pushes a generally incompressible hydraulic fluid that drives a push bar, which is housed within the tube, outward. A mechanical advantage exists between the larger size pistons, which the compressed gas pushes against, versus the smaller size push bar, which the oil fluid pushes against. The push bar drives a force equalization bar 140 that connects the gliding bars 126 to the net system 112, thus raising the net system. Rubber bumpers or other impact absorbing devices may be installed on the force equalization bar 140 to lessen impact of the force equalization bar engaging the vertical support or other component once the net system is in the "up" position. To let the net system 112 down, the tension device 132 pulls the gliding bars 126 and force equalization bar 140 which pulls the push bar inward which pushes the hydraulic fluid back to a pressurized reservoir and re-compress the inert gas, to re-load the instantaneous pull back system. As an alternative, a pump may be used to move the hydraulic fluid back into the pressurized reservoir. A series of valves are opened and closed to pump the hydraulic fluid back into a reservoir and re-set the system. Further embodiments of the present invention may provide alternative devices for raising and lowering the net system. Non-limiting examples may include jacking systems or combinations thereof to raise and lower the net.

Once the net system 12 is pulled up to the desired height, the barrier system of FIGS. 1, 4, and 5 includes a gliding bar retainer 42 for selectively fixing the gliding bars 26 relative to the energy absorption units 30 such that the gliding bar defines a fixed mode. The gliding bar 26 of FIG. 1 selectively defines an unfixed mode in which the gliding bar is moveable relative to the energy absorption unit 30 and defines a fixed mode wherein the gliding bar is fixed relative to the energy absorption unit. The gliding bar 26 of FIG. 1 is selectively convertible between the unfixed mode and the fixed mode based upon the relative position of the gliding bar retainer 42. The gliding bars 26 include an outer surface that defines at least one notch 44, and preferably a plurality of notches on opposite sides of the gliding bar, which can be selectively engaged by the gliding bar retainer 42. The gliding bar retainer 42 of FIGS. 1, 4, and 5 comprises a plate 46 that engages the energy absorption unit 30 on an end opposite the vertical support 16. The plate 46 defines an opening through which the respective gliding bar 26 passes. The gliding bar retainer 42 further comprises two flange devices 48 proximate the opening such that movement of the flange device selective engages the notches 44 such that the gliding bar 26 is fixed relative to the energy absorption unit 30 to define a fixed mode of the gliding bar. The flange devices 48 of the gliding bar retainer 42 of FIGS. 4 and 5 are disposed to one another by a spring device 50 attached to the two flanges above and/or below the gliding bar 26. In addition, the three gliding bar retainers 42 of FIGS. 1, 4, and 5 can be moved in unison with an actuation device, such as a solenoid, motor, or the like to list one non-limiting example, with the connector rods 52 that are attached to the three sets of flange devices 48. Therefore, the gliding bars 26 can be pulled back by the winch system 38 while the gliding bars define the unfixed mode until the net system 12 is in the desire position, such as the "up" position, and then the flange devices 48 of the three gliding bar retainers 42 automatically engage a notch 44 in the gliding bar to define the fixed mode of the gliding bars. Similarly, the net system 12 can be lowered by selectively disengaging the flange devices 48 of the gliding bar retainers 42, preferably after the winch system 38 has pulled the gliding bars 26 back a slight amount to release the pressure on the flange devices, such that the gliding bars define the unfixed mode and the tension device 32, along with the weight of the net system, pulls the gliding bars relative to the energy absorption unit. It should be noted that the notches 44 of the gliding bars 26 and flange devices 48 of the gliding bar retainers 42 must be appropriately dimensioned to withstand the impact forces generated when a vehicle is stopped by the barrier system 10. One non-limiting example of an appropriately dimensioned system includes one inch thick pivoting steel plates for the flange devices that lock into notches greater than one inch cut into the sides of solid steel gliding bars. Multiple notches are provided in the gliding bars to allow locking to occur at various net system heights. During an impact event, the flange devices hold the gliding bar against a twelve inch by twelve inch steel plate, which bears against the energy absorption unit and compresses it during an impact event, to describe one non-limiting example.

FIGS. 2, 3, and 6 illustrate an alternative gliding bar retainer 142 with collar device 148 comprising a ball bearing assembly for automatic engagement with the gliding bar 126 to define the fixed mode of the gliding bar. The gliding bar 126 includes a plurality of cross-sectional grooves 144 cut around the outer surface of the gliding bar 126. The collar device 148 includes ball bearings that fall into the groove and lock the gliding bars 126 to the gliding bar retainer 142. To disengage the gliding bar retainer 142, the collar device is pulled back using a motor to release the ball bearings from the respective groove 144, such that the gliding bars define the unfixed mode.

FIG. 7 illustrates yet another gliding bar retainer 242 for the barrier system 210 in which at least one removable pin connection retains the gliding bar 226 relative to the plate 246. The pin 248 includes a cross member 250 to keep the pin from inadvertently falling through openings 244 in the gliding bar 226. A pin 248 that has been manually, or automatically in further embodiments of the invention, inserted into the opening 244 of the gliding bar engages the plate 246, such that the gliding bar defines the fixed mode, whereas the gliding bar defines the unfixed mode when no pin is inserted into the openings of the gliding bar and/or when the pin does not engage the plate. The gliding bar 226 defines a plurality of openings 244, such as openings of one and five-eighths inch diameter that are spaced one inch apart, to describe one non-limiting example of a plurality of openings, such that the net system 212 can be fixed at a number of different heights or the net system can define various levels of tautness. Still further embodiments of the present invention provide alternative gliding bar retainer devices for selectively fixing the gliding bar relative to the energy absorption unit when the gliding bar defines the fixed mode.

Referring again to FIG. 1, the three gliding bars 26 of the illustrated embodiments are connected at the net end to a force equalization bar 40 that connects the net system 12 to the gliding bar. The force equalization bar 40 of FIG. 1 is a three inch diameter high strength solid steel force equalization bar, to describe one non-limiting example of a force equalization bar size and material. The net end of each gliding bar 26 is cut out into a semi-circle shape to allow the force equalization bar 40 to be inset into the gliding bar to thereby form a relatively strong connection. These connections are both welded and wrapped by a strap, such as a one inch by three inch wide steel bar strap to list one non-limiting example, to provide additional strength. The force equalization bar 40 of FIG. 1 is connected at three equidistant locations to the horizontal solid steel gliding bars 26 on one side and at four equidistant locations to the net system 12 using removable connections. The removable connections are rounded and allow the net to pivot around the force equalization bar during an impact event. The three gliding horizontal bars are effectively pulling on one side of the force equalization bar, and the four removable net system connections are pulling on the other side, balancing out and distributing the forces across the force equalization bar and applying substantially equivalent forces to each of the three energy absorption units. Further embodiments of the present invention comprise alternative numbers of energy absorption units, alternative connections for the energy absorption units and/or net system, alternative sizes and materials of the force equalization bar, and alternative devices for distributing the forces among the at least one energy absorption units.

Referring now to the barrier system 310 of FIGS. 8 and 9, the gliding bars 326 define an axial length that is selectively adjustable. The gliding bar 326 comprise a solid portion 360 that is proximate the net end of the gliding bar and extends axially to at least the gliding bar retainer 342 such that when the gliding bar defines the fixed mode, the gliding bar provides sufficient material properties to withstand the impact forces, similar to the gliding bars in the previously discussed embodiments. The gliding bar 326 further comprises a sleeve 362 and a core 364 located between the gliding bar retainer 342 and the gliding bar connector 334 such that when the gliding bar defines the unfixed mode and the gliding bar is moved relative to the energy absorption unit 330, the gliding bar is configured to extend an additional length to allow the net system 312 to lower further than in the previously disclosed embodiments of the present invention. The sleeve 362 and core 364 are adapted to axially move relative to one another to define an axial length of the gliding bar 326 that is adjustable. One the gliding bar connector 334 engages the vertical support 316 or other surface of the end support, the sleeve 362 is able to axially move relative to the core 364 to further lower the net system 312, as shown in FIG. 9, which allows the net system to lower well beneath a waterway to allow passage of watercraft to describe one non-limiting use of the gliding bar with selectively adjustable length.

For the barrier system 310 of FIGS. 8 and 9, the gliding bars 326 comprise solid portion 360 of steel gliding bars three and a half inches by three and a half inches by approximately eight feet in length. The solid portion 360 is welded, at the end opposite the net end, to a sleeve 362 that is three and a half inches by three and a half inches by approximately fifteen feet in length. Opposite the sleeve 362 from the solid portion 360, the core comprises a steel bar that is two and a half inches by two and a half inches by approximately fifteen feet in length to provide telescopic lengthening and shortening of the gliding bar 326 to define an axial length that is selectively adjustable. For the embodiment of FIGS. 8 and 9, when the net system 312 is in the "down" position, the gliding bars 326 can be extended to about thirty eight feet and when the net system is in the "up" position, the gliding bars may be reduced in length to about twenty three feet. Further embodiments of the barrier system of the present invention comprise alternative shapes, sizes, materials, and components to provide a gliding bar that defines an axial length that is selectively adjustable to provide sufficient vehicle clearance from a net system in the "down" position.

Referring now to FIG. 10, the barrier system 410 comprises a first end support 414 and a second end support 470 opposite the net system 412 from the first end support, such that the second end support comprises vertical supports, energy absorption units, gliding bars, and other components of the first end support to further absorb energy during impact. The net system 412 may span across any area through which access to vehicles is desired to be restricted. The second end support 470 does not necessarily require a winch system 438 or other device for raising and lowering the net or a gliding bar retainer 442 to selectively define the fixed and unfixed modes of the gliding bars 326. Rather the second end support 470 defines a fixed mode between the gliding bars and energy absorption unit with a pin connector 472 and plate 474 without the need to selectively convert the gliding bar from the fixed mode to an unfixed mode to lower the net to the "down" position. However, further embodiments of the present invention comprises alternative barrier systems that include a second end support substantially equivalent to the first end support such that the gliding bars for each end support can be selectively converted between the fixed modes and unfixed modes to raise and lower, respectively, the net system. Referring to FIGS. 11 and 12, the barrier system 410 of FIG. 10 is illustrated as restricting access through a waterway in FIG. 11 and allowing access through the waterway in FIG. 12. Further embodiments of the present invention restrict access and provide access to alternative passageways in similar fashion.

The barrier system 510 of FIG. 13 includes a net system 580 that selectively denies access throughout the depth of a waterway, such as from the bottom of the channel to above the waterway. As shown in FIG. 13, the net system 580 extends above the waterway in a fashion similar to the previously discussed embodiments; however, the net system extends bellow the waterway and is anchored along the bottom of the waterway using anchors 582, such as earthen anchors driven five to ten feet into the subsurface of the waterway, to describe one non-limiting example of anchors. The anchors include release devices that allow divers with special unlocking devices to release the bottom of the net system 580 from the anchors 582. When the net system 580 is locked to the anchors 582, the barrier system 510 provides a full depth net system, thus surface marine traffic, submarine vessels, and divers are denied access. When the net system 580 is lowered, the net system settles to the bottom of the channel and allows access through the channel to surface vessels, submarine vessels, and divers.

The barrier system 610 of FIG. 14 is capable of providing protection to areas that are not proximate land such that an earth-based anchoring system, such as the anchoring system of FIG. 1, is not available. The barrier system 610 comprises an anchoring system 620 that comprises a buoy system. The area to be protected of FIG. 14 includes an offshore oil and/or gas facility, although further embodiments of the present invention may be used to protect any area or facility. The vertical support 616 of the end support 614 comprises a relatively large buoy, such as a buoy six feet in height to describe one non-limiting example, through which the gliding bars 626 slide and against which the energy absorption units engage. The net system is attached between the buoyed end supports and can be raised and lowered as described above for the previously disclosed embodiments. The anchoring system 620 of FIG. 14 comprises the buoy, a cable 686, and an anchor device 688; however, further embodiments of the present invention include alternative anchoring systems for non-land based end supports.

FIG. 15 comprises a barrier system 710 comprising two end supports 714 with two net systems 712 that are each connected to opposite sides of an intermediate post 790. The barrier system 710 of FIG. 15 enables protection of relatively wide waterways or other areas by providing intermediate post 790 through which gliding bars slide and are retained with energy absorption units on both sides of the intermediate post 790. The intermediate post of FIG. 15 is anchored to the bottom of the waterway; however, further embodiments of the present invention comprise alternative anchoring systems for the intermediate post, such as with buoys or the like, to list one non-limiting example.

Referring now to the net systems of the illustrated embodiments of the present invention, the net system comprises spectrum fibers, which are high strength and low weight fibers. The rope fibers are further enhanced by a recrystallization process, which further strengthens the rope fibers. Rope members and fibers will not degrade substantially or lose strength in water or saltwater. A non-limiting example of such rope fibers is available from Puget Sound Rope located in Anacortes, Washington. Horizontal rope members are preferably one inch to one and a half inches in diameter, and there are also preferably four horizontal members equidistant at fifteen inches on center. Vertical rope members are preferably one half inch to one inch in diameter, and made of the same spectrum fiber and preferably spaced at two feet on center. The vertical rope members may be threaded through the horizontal members, and tied at the top and bottom horizontal ropes. This interlocking net system design and the spacing of its members and diameter of the ropes used are optimum in absorbing the impact forces, and allow the net systems to distribute the impact force almost equally across the net members, to the vertical force equalization bars, if provided and to the energy absorption units, and dissipate impact energy through the end supports. The net system provides minimal stretch upon high impact. Furthermore, the net system will not significantly creep or stretch when remaining in an "up" position, with constant tension load being applied. Further embodiments of the present invention may include alternative net materials other than enhanced spectrum fibers, alternate net design configurations (such as the number and spacing of horizontal and vertical rope members), and alternate attachment methods of net members to achieve the requisite energy absorption properties and net tension strength properties. In further embodiments of the barrier system, the rope members can be wrapped in a jacket or covered by a sleeve for additional protection against scarring, weather, and ultraviolet radiation. The color of the sleeve and/or net system may be red, yellow, or other color which provides high visibility, or conversely, the sleeve and/or net system may be a color or color scheme that provides low visibility, based upon the desired objective of the barrier system. For high visibility applications, reflective tape or glow in the dark coatings may be applied to the net system to improve its visibility. Low voltage flood lights may also be implemented in further embodiments of the present invention to shine across the net system while in the "up" position. Additionally, a trough can be installed along the bottom of a roadway, channel, or other protected passageway from one end support to the other so that when the net system is lowered it lays into the protective trough.

The energy absorption units of the illustrated embodiments are capable of absorbing approximately 120,000 pounds of force, and afterwards, resume their original shape. The energy absorption units of the illustrated embodiments are large springs about thirty four inches long, ten inches in diameter with high strength steel about one and five eighths inches in diameter that are pulled into compression. For the barrier systems of FIGS. 10–14, there are six energy absorption units which preferably absorb 20,000 pounds of force each and provide about twenty four inches of "cushion" or "give" upon initial impact (each energy absorption unit compresses about twelve inches for a total of about twenty four inches from both sides). This is critical to stopping a 20,000 pound vehicle, such as a marine vessel, at an impact speed of fifty miles per hour or any impact with approximately 450,000 pounds of force or more. The initial 120,000 pounds of impact force is absorbed, energy absorbers give approximately twenty four inches, which allows for more than ten feet of marine vessel penetration. The net system also stretches allowing for additional penetration. During the time that the energy absorbers give approximately twenty four inches and the net stretches, the vehicle, such as a marine vessel, decelerates significantly and kinetic energy is dissipated through the end supports and into the ground. After the net system reaches maximum stretch, the final impact force where the vehicle is jolted to a stop is far less, because significant kinetic energy has already been dissipated and the vessel has decelerated. The vehicle is jolted back and rebounds. Further embodiments of the present invention may include any number of energy absorption units of alternative shapes and sizes and/or alternative force absorption as required by the specific application of the barrier system.

For the waterway applications of the barrier system, such as the barrier system 410 of FIGS. 10–12, debris may collect in the net system 412 while the net system is positioned on the bottom of the waterway. However, most debris which collects in the net system will be released when the net system is raised up. If the net system 412 requires cleaning or basic maintenance, the net system can be disconnected from one end, laid on top of buoy supports, and pulled across the waterway using the winch. Any remaining debris can be removed from the net system once the net system is stretched out on dry ground or other surface.

Referring now to the winch system 38 of FIG. 1 or the hydraulic system 138 of FIG. 2, the winch system or hydraulic system, respectively, operates from multiple 12 volt, 24 volt, or 48 volt common batteries arranged in parallel or series. Advantageously, deep cycle marine batteries are used because of their ability to hold a charge longer. Controls allow use of only a first battery, a second battery, or both together, and preferably a volt meter and amp meter continuously reads out remaining battery charge. A solar panel 94, 194 designed specifically for recharging the batteries is included in the illustrated embodiments of the barrier systems 10 and 110, respectively, to constantly provide a trickle recharge to both batteries, thus the barrier system of the present invention is autonomously powered. The batteries can alternatively be recharged using simple jumper cables, similar to jumping an automobile battery. The battery powered winch can raise and lower the net system more than twenty times in a day without causing the system batteries to fully drain down power. The battery powered winch system can be operated with a wireless signal, allowing one to raise and lower the net system remotely. Where required, an external electrical power source can be used to operate the winch and provide constant recharging to the battery backup system. A programmable logic controller (PLC) is implemented as part of the control systems to sequence controls to operate the winch, limit switches, open and close valves if using pneumatic or hydraulic pullback systems, send alarm signals, and disengage the horizontal bar locking mechanisms. Further embodiments may include alternate power supplies and/or control devices for raising and/or lowering the net system.

The barrier system of the illustrated embodiment also provides an alarm system which is activated when the barrier system has been impacted or if a portion of the net system is cut. A waterproof flexible wire is run between members of the net system and the outer protective sleeve. If cut or impacted, the broken wire will signal an alarm. In addition, an infrared alarm device may also be installed to beam light across each six foot by six foot vertical supports at the end support. If both infrared light beams are broken simultaneously, which would occur during an impact event, an alarm signal will be sent and trigger the alarm. This dual infrared light alarm requires minimal power (milliamps per day) and is also powered by the dual batteries with solar power recharge. On a temporary basis, the alarm system can advantageously be turned off with a key or other device at the control panel of an end support and/or by wireless signal. Further embodiments of the present invention may include alternative alarm systems.

A roof system above the end support protects the barrier system components from snow, ice, and rain. Alternatively, a locking shed building may be installed over one or more end supports by sliding the building over the end support and securing the building to the existing anchoring system. This locked building will prevent access to the contained barrier system components. Further embodiments of the present invention include alternative enclosures for protecting the barrier system components from the elements or from vandalism.

The system components, such as the vertical supports, energy absorption units, gliding bars, net system, and other components are all modular and meet size and weight limitations on military shipping containers, allowing systems to be packaged and shipped anywhere. Furthermore, the connections allow assembling and disassembling the barrier system without damage. Preferably, the vertical supports are cut to length and have wheels and openings with sleeves installed. The vertical supports are first anchored into the anchoring system. Then the gliding bars, with the energy absorption units oriented generally coaxial thereto, are slid through the openings in the vertical supports and the force equalization bar is connected to the gliding bar using welded and strapped steel connections at three locations. The four horizontal members of the net system are connected to the force equalization bar at four locations using the provided screwed pin shackles or comparable connectors. The net system can be easily removed by disconnecting these screwed pin shackles. The net system may be installed or removed from the barrier system in a waterway application by unrolling the net system across the waterway onto rafts which support the weight of the net, and then pulling it across the waterway and connecting it to the other end support in a similar manner. Therefore, various embodiments of the present invention allow one person to completely install and/or remove the net system from the end supports. Further embodiments of the present invention may provide installation procedures having additional or alternative steps.

The winch system, net system, structural members, energy absorption units, various connections, batteries, solar power recharger, and other components can be used in any environmental condition and as such is intended for "all weather" use. The systems were designed to be simple to use with minimal ongoing monthly maintenance and manpower requirements. Non-limiting examples of typical maintenance include 1) checking the charge on the battery system, 2) ensuring the alarm system is active, and 3) providing moving components with lubricant.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A barrier system for stopping vehicles, the barrier system comprising:

an anchoring system;

at least one end support attached to the anchoring system, wherein the end support comprises at least one vertical support;

at least one energy absorption unit supported by the vertical support;

a gliding bar that selectively defines an unfixed mode wherein the gliding bar is moveable relative to the energy absorption unit and defines a fixed mode wherein the gliding bar is fixed relative to the energy absorption unit, wherein the gliding bar is selectively convertible between the unfixed mode and the fixed mode and wherein the gliding bar defines a net end and a distal end opposite the net end;

a net system connected to the net end of the gliding bar; and at least one gliding bar retainer for selectively fixing the gliding bar relative to the energy absorption unit when the gliding bar defines the fixed mode such that the gliding bar retainer remains locked and moveable with the gliding bar during energy absorption.

2. A barrier system according to claim 1 wherein the gliding bar is moveable relative to the energy absorption unit in a generally horizontal direction.

3. A barrier system according to claim 1 wherein the gliding bar defines an axial length that is selectively adjustable.

4. A barrier system according to claim 3 wherein the gliding bar comprises a sleeve and a core, wherein the sleeve and core are axially slideable relative to one another to define the gliding bar axial length that is selectively adjustable.

5. A barrier system according to claim 1 wherein the gliding bar defines at least one notch on an outer surface of the gliding bar and wherein the at least one gliding bar retainer comprises a flange device for selectively engaging the at least one notch to define the fixed mode of the gliding bar.

6. A barrier system according to claim 1 wherein the at least one gliding bar retainer defines a collar device for selectively engaging an outer surface of the gliding bar to define the fixed mode of the gliding bar.

7. A barrier system according to claim 2 wherein the at least one gliding bar comprises at least one removable pin connection to define the fixed mode of the gliding bar.

8. A barrier system according to claim 1, further comprising a force equalization bar that connects the net system to the at least one gliding bar.

9. A barrier system according to claim 1, further comprising an alarm system that provides an alarm signal in the event of a barrier system impact.

10. A barrier system according to claim 9 wherein the alarm system comprises at least one wire embedded in the net system that provides an alarm signal if the wire is broken.

11. A barrier system according to claim 1 wherein the energy absorption unit comprises a compression spring.

12. A barrier system according to claim 1 wherein the anchoring system comprises a buoy system.

13. A barrier system according to claim 1, further comprising a winch system connected to the gliding bar for raising and lowering the net system.

14. A barrier system according to claim 1, further comprising a hydraulic system connected to the gliding bar for raising and lowering the net system.

15. A barrier system according to claim 1, further comprising a wireless signal device for remotely raising and lowering the net system.

16. A barrier system for stopping vehicles, the barrier system comprising:

an anchoring system;

at least one end support attached to the anchoring system, wherein the end support comprises at least one vertical support;

at least one energy absorption unit supported by the vertical support, wherein the at least one energy absorption unit comprises a compression spring;

a gliding bar that selectively defines an unfixed mode wherein the gliding bar is moveable relative to the energy absorption unit and defines a fixed mode wherein the gliding bar is fixed relative to the energy absorption unit, wherein the gliding bar is selectively convertible between the unfixed mode and the fixed mode and wherein the gliding bar defines a net end and a distal end opposite the net end;

a net system connected to the net end of the gliding bar; and at least one gliding bar retainer for selectively fixing the gliding bar relative to the energy absorption unit when the gliding bar defines the fixed mode such that the gliding bar retainer remains locked and moveable with the gliding bar during energy absorption;

wherein the at least one gliding bar is generally coaxially aligned with the compression spring of the energy absorption unit.

17. A barrier system according to claim 16 wherein the gliding bar is moveable relative to the energy absorption unit in a generally horizontal direction.

18. A barrier system according to claim 16 wherein the gliding bar defines at least one notch on an outer surface of the gliding bar and wherein the at least one gliding bar retainer comprises a flange device for selectively engaging the at least one notch to define the fixed mode of the gliding bar.

19. A barrier system according to claim 16 wherein the anchoring system comprises a buoy system.

20. A barrier system according to claim 16, further comprising a wireless signal device for remotely raising and lowering the net system.

* * * * *